United States Patent [19]

Shingō

[11] 4,371,365

[45] Feb. 1, 1983

[54] APPARATUS FOR FITTING AND STACKING BAGS ONTO PINS

[75] Inventor: Hiromichi Shingō, Yokohama, Japan

[73] Assignee: Toyo Shokuhinkikai Kabushiki Kaisha, Yokohama, Japan

[21] Appl. No.: 176,644

[22] Filed: Aug. 11, 1980

[30] Foreign Application Priority Data

Aug. 31, 1979 [JP] Japan ..... 54/111251

[51] Int. Cl.[3] ..... B31B 1/98

[52] U.S. Cl. ..... 493/25; 493/34; 493/204; 493/926; 198/692

[58] Field of Search ..... 493/204, 203, 194, 193, 493/226, 926, 25, 34, 8; 198/692, 693; 271/DIG. 10

[56] References Cited

U.S. PATENT DOCUMENTS

| | | | |
|---|---|---|---|
| 3,431,828 | 3/1969 | Crawford et al. | 493/204 |
| 3,555,977 | 1/1971 | Saumsiegle | 198/692 X |
| 3,805,683 | 4/1974 | Hook | 493/204 X |
| 3,813,998 | 6/1974 | Lotto | 493/204 X |
| 4,292,033 | 9/1981 | Wolske | 493/204 X |

*Primary Examiner*—James F. Coan

*Attorney, Agent, or Firm*—Browdy & Neimark

[57] ABSTRACT

An improved apparatus for fitting and stacking bags onto wicket pins which makes it possible to efficiently carry out a sequence of procedures ranging from the production of the bag from a film to stacking of the bags onto the wicket pins and in which sealing and cutting of the film to produce the bag by a seal-knife and a sealing roller, clamping of the bag by intermittent conveyor means and fitting of a pair of holes at the lip of the bag onto the wicket pins by pushers are carried out at the time of stop of intermittent operation. The apparatus has a simplified construction and reduces power consumption.

5 Claims, 7 Drawing Figures

APPARATUS FOR FITTING AND STACKING BAGS ONTO PINS

BACKGROUND OF THE INVENTION

This invention relates to an apparatus for piercing a predetermined number of bags, each having a pair of holes punched in a lip portion, with wicket pins and stacking the bags onto the pins.

As stacking apparatus of this kind, there is known a conventional a system which sucks an individual finished bag by a suction member which rotates either in one direction or in both directions using a vacuum pump and which fits the bag onto wicket pins. According to this system, however, the suction member sometimes fails to perfectly suck the bag or bags, or the bags come off from the suction member or rub one another. In particular, when the sucking speed is increased in order to improve the production efficiency, the suction time becomes inevitably shorter whereby these tendencies are further promoted. If the suction member is of a one-way rotation type, the construction of the connection portion between the suction member and the vacuum pump becomes complicated. This also holds true if the suction member is of the type that rotates in both directions. Hence, with both types it is difficult to attain the high speed operation, and they call for a vacuum pump of a large scale, the result being generation of a great amount of noise and increased power consumption.

Another system has also been known in which, while both upper and lower end portions of a bag are clamped by clamp belts rotating continuously, the bags are continuously transferred onto the wicket pins and fitted and stacked onto the pins by means of pushers. According to this system, however, it is difficult to correctly fit the pair of holes of each bag to the wicket pins because the clamping of the bag and the fitting of the bag onto the wicket pins can not be carried out in a reliable manner owing to the rotation of the clamp belts.

SUMMARY OF THE INVENTION

The present invention is directed to eliminate the abovementioned problems with the prior art. The first characterizing feature of the present invention is provision of an apparatus for fitting and stacking the bags onto the wicket pins which apparatus makes it possible to efficiently carry out a sequence of procedures ranging from the production of the bag from a film to the stacking of the bags.

The second characterizing feature of the present invention is provision of an apparatus in which sealing and cutting of the film to produce a bag by a seal-knife and a sealing roller, clamping of the bag by intermittent conveyor means consisting of a pair of upper and lower pick-off belts and fitting of a pair of holes of the bag to the wicket pins by pushers are carried out at the time of stop of the intermittent operation, respectively, so that the bags are reliably held and conveyed and a pair of holes bored in the tip of each bag are correctly fitted and stacked onto the wicket pins.

The third characterizing feature of the present invention is provision of an apparatus for stacking bags onto pins which does not need a complicated mechanism or large power consumption as in the conventional apparatuses of the suction type using a vacuum pump and which does not generate noise and which reduces the power consumption.

Still another characterizing feature of the present invention is provision of an apparatus which prevents the leading edge portion of the film from being double-hit and damaged by the seal-knife once a predetermined number of bags are stacked onto the wicket pins by rotating the feed rollers slightly in the reverse direction.

Further, the apparatus of the present invention makes it possible to reliably prevent the occurrence of crease or turn-up of the bags during production of the bags by furnishing the intermittent conveyor means with pick-off rollers and belt conveyors at the leading edge portion of the means in order to further ensure the clamping of the bag and its intermittent transfer.

Still another characterizing feature of the present invention is the arrangement in which the positions of the wicket pins are adjustable in the conveying direction of the bag as well as in the direction at right angles to the conveying direction in order to correctly align the wicket pins to the positions of the holes of the bag at all times.

Other features of the present invention will become more apparent from the following detailed description of an embodiment thereof in connection with the accompanying drawings.

DESCRIPTION OF THE PREFERRED EMBODIMENT

Hereinafter, a preferred embodiment of the present invention will be described with reference to the accompanying drawings. A pair of upper and lower feed rollers 1, rotate intermittently in opposite directions to each other. In front of these feed rollers are disposed a seal-knife 2, which is driven to intermittently move in the vertical direction by an optional mechanism, and a sealing roller 3, which is driven to intermittently rotate in synchronism with the seal-knife 2 and which is arranged to oppose the seal-knife 2 in the vertical direction. The pair of feed rollers 1, 1 clamp and convey intermittently, in a distance of a bag width, a film C which is folded double to leave its lip portion A and has a pair of holes B, B bored on the lip portion. When the feed rollers 1, 1 stop, the seal-knife 2 and the sealing roller 3 operate intermittently, heat-seal the film and at the same time, cut the film thereby to form a bag D. The intermittent operation of the feed rollers 1, 1 is automatically stopped when a preset counter counts a predetermined number of bags D inserted on wicket pins to be described elsewhere.

Figure 1:
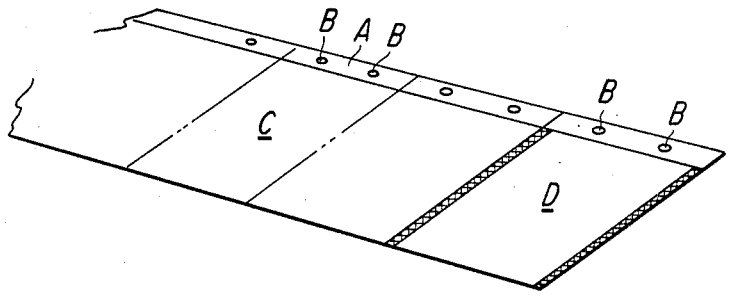
FIG. 1 is a perspective view of the bag to be used in the present invention.
Figure 3:
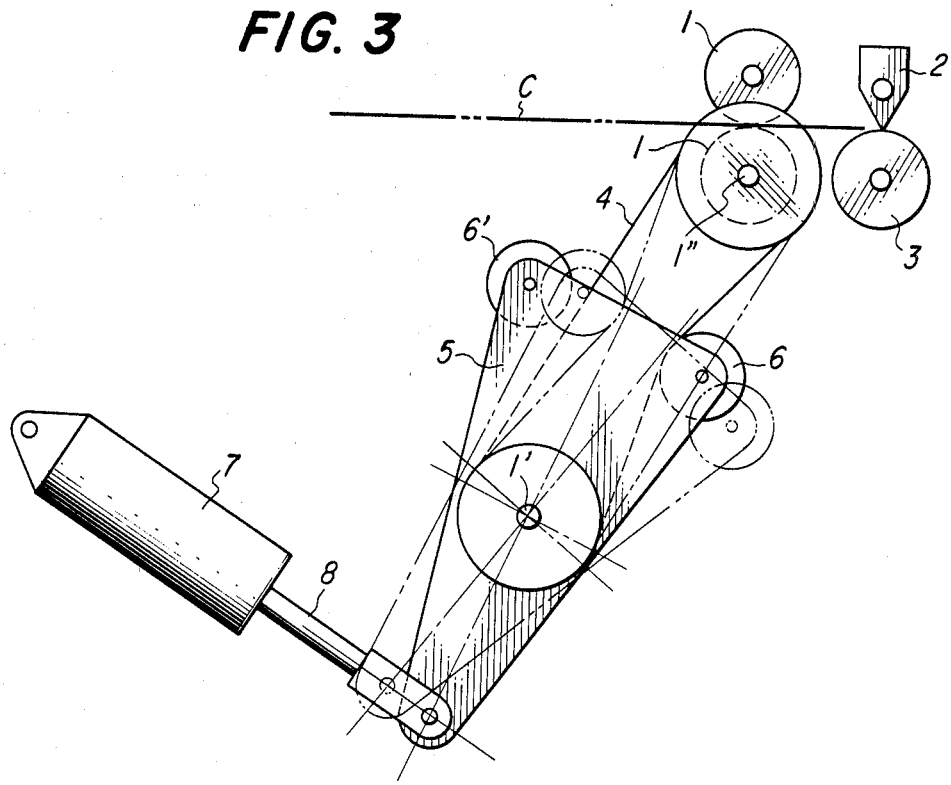
FIG. 3 is a schematic view useful for explaining the film damage prevention mechanism of the present invention.
Figure 2:
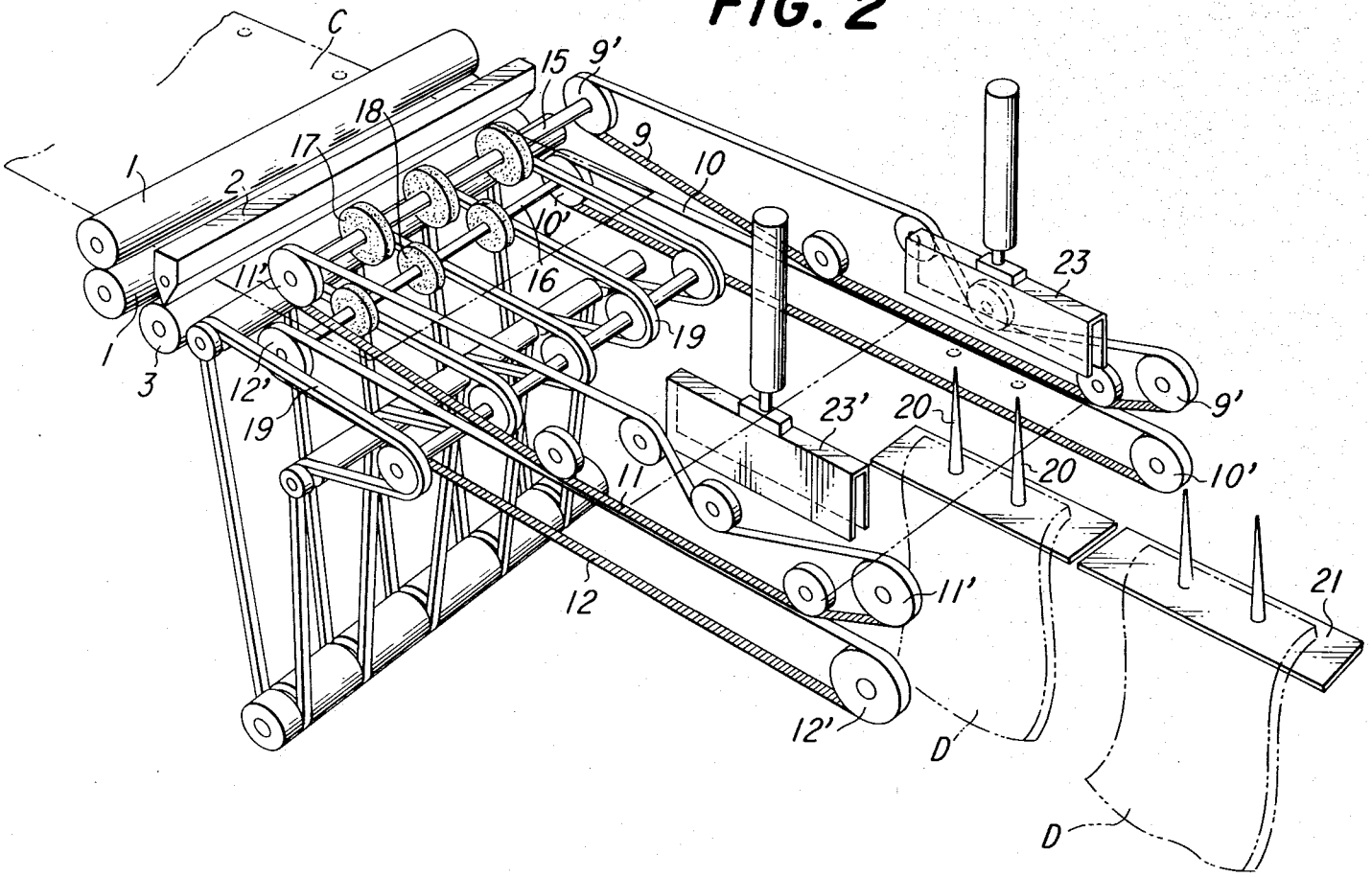
FIG. 2 is a perspective view of the apparatus in accordance with the present invention.
Figure 4:
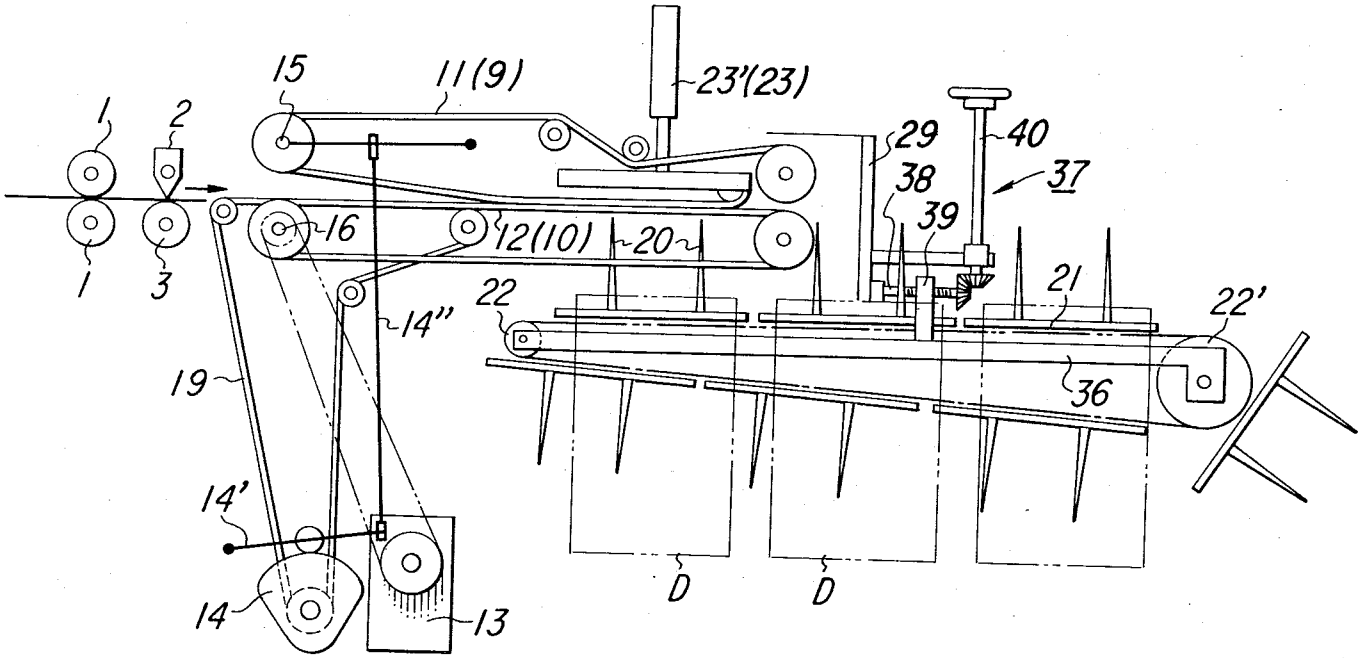
FIG. 4 is a schematic view as viewed from the side of the apparatus of the invention.
Figure 5:
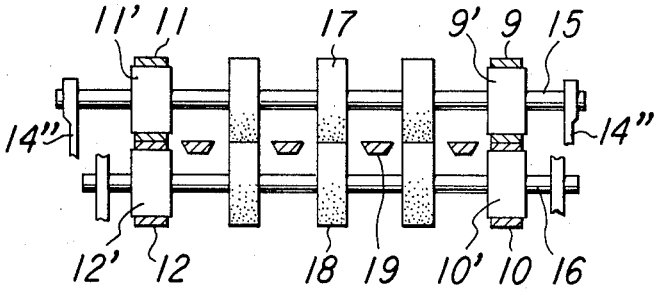
FIG. 5 is a longitudinal sectional front view of the leading edge portion of the intermittent conveyor means of the present invention.
Figure 6:
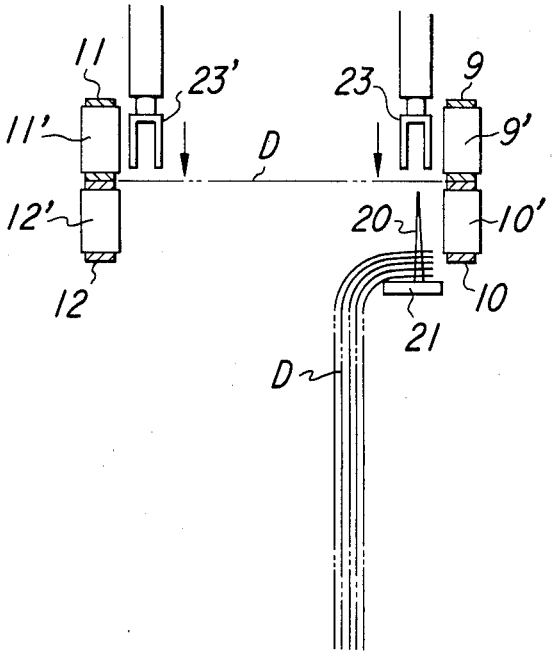
FIG. 6 is also a longitudinal sectional front view of the leading edge portion of the intermittent conveyor means of the present invention.

A timing belt 4 connects a driving shaft 1' for intermittently rotating the lower feed roller 1 to a shaft 1'' of the lower feed roller 1. On both sides of the timing belt 4, there are disposed tension rollers 6, 6' that are pivoted to a bracket 5 as shown in FIG. 3 and are capable of coming into pressure contact with each other. The tip of the bracket 5 is connected to a piston rod 8 of a cylinder 7. The piston rod 8 extends during the intermittent operation of the feed rollers 1, 1, thereby bringing the tension roller 6 into pressure contact with the timing belt 4 but separating the tension roller 6' from the timing belt 4. When the preset counter finishes counting the predetermined number of bags and the feed rollers 1, 1 stop operating, however, the piston rod 8 contracts, thereby separating the tension roller 6 from the timing belt 4 but bringing in turn the tension roller 6' into pressure contact with the timing belt 4. According to this arrangement, the feed roller 1 is caused rotate slightly in the reverse rotating direction and the leading edge of the film C is moved slightly backwardly at the time the intermittent operation of the feed rollers 1, 1 is stopped, thereby to prevent the leading edge of the film C from being hit repeatedly and damaged by the seal-knife 2 that is constantly operating.

On both sides in front of the seal-knife 2 and the sealing roller 3 are stretched pairs of upper and lower pick-off belts 9–10 and 11–12 that are driven for intermittent rotation by means of an intermittent driving device 13 via pullies 9', 9'', 10', 10'' and 11', 11'', 12', 12'', respectively. The leading edge portions of the upper pick-off belts 9 and 11 in particular are formed movably in the vertical direction by a pick-off cam 14 and connecting rods 14', 14''. These upper pick-off belts 9, 11 are constructed in such a fashion that they elevate when the feed rollers 1, 1 feed the film onto the upper portions of the lower pick-off belts 10, 12, descend when the delivery of the film C onto the lower pick-off belts 10, 12 is completed and intermittently clamp and convey the bag D after the upper and lower pick-off belts 9, 10, 11, 12 together clamp both upper and lower end portions of the bag D produced.

A proper number of rubber pick-off rollers 17, 18 are fixed to pulley shafts 15, 16 at the leading edge portions of the abovementioned pairs of pick-off belts 9–10 and 11–12, respectively, so as to oppose one another and clamp the center portion of the bag D together with the pick-off belts 9–10, 11–12. At the leading edge of the lower pick-off belts 10, 12, rope belt conveyors 19 are stretched to constantly rotate on the same plane as the pick-off belts in order to support the lower part of the bag D to prevent the occurrence of creasing and turn-up and to permit the pick-off belts 9–10, 11–12 to clamp the predetermined positions of the upper and lower portions of the bag D.

A leading edge of a wicket conveyor 21 having pairs of wicket pins 20, 20 implanted projectingly into its surface is stretched for the intermittent rotation via chain wheels 22, 22' inside the trailing edge of the pick-off belts 9, 10 on the side of the lip A of the bag D of the above-mentioned pair of upper and lower pick-off belts 9–10, 11–12. Pushers 23, 23' of an inverted U-shape are disposed above a pair of wicket pins 20, 20' at the leading edge of the wicket conveyor 21 and above and inside the pick-off belts 11, 12 facing the wicket pins. These pushers are driven for the intermittent motion in the vertical direction. When the upper and lower pick-off belts 9, 10, 11, 12 stop rotating, the pushers 23, 23' operate in such a fashion that both end portions of the bag D, that is being clamped and conveyed, are pushed downwardly and are released from the pick-off belts 9–10, 11–12. Especially, the pusher 23 is constructed in such a fashion as to fit a pair of holes B, B of the lip portion A of the bag to the wicket pins 20, 20.

Figure 7:
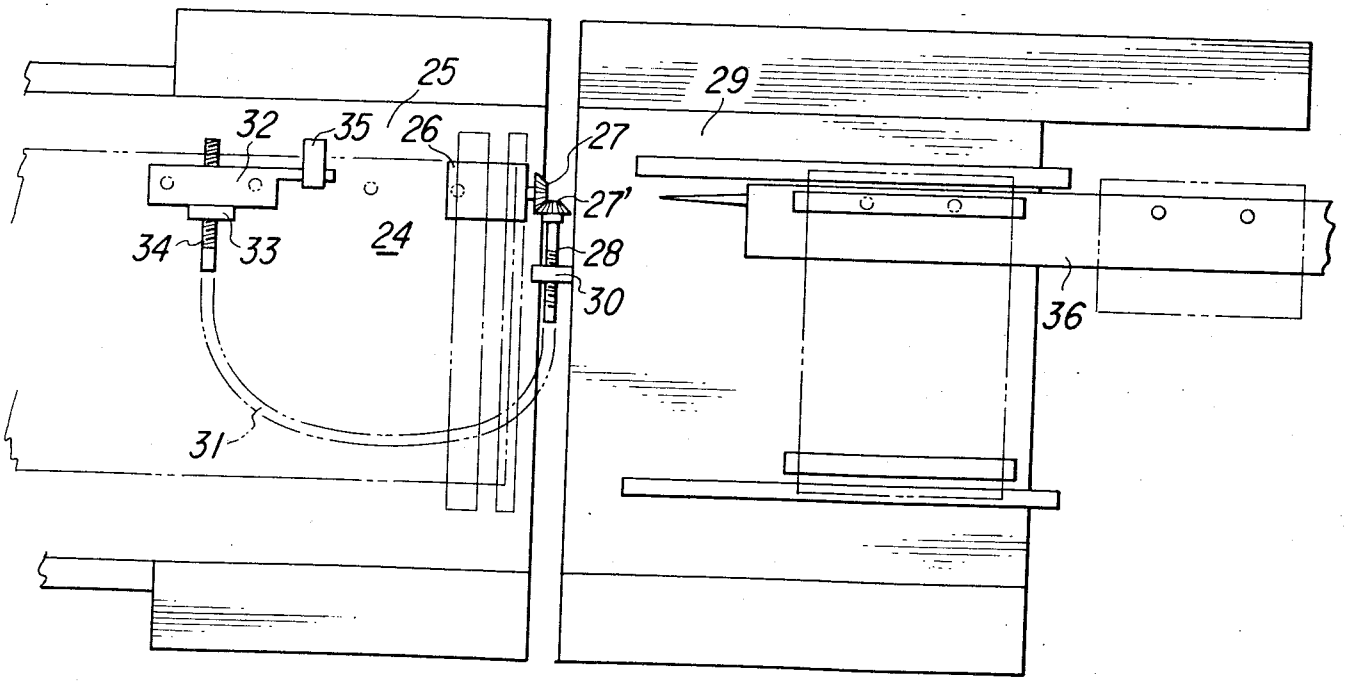
FIG. 7 is a schematic view useful for explaining the position adjuster for adjusting the position in the direction at right angles to the bag conveying direction in accordance with the present invention.

A regulating device 24 for holding the pair of holes B, B of the bag D on the same line as the wicket pins 20, 20 is shown in FIG. 7.

Namely, a motor 26 equipped with a reduction gear is mounted on a support frame 25 of the feed rollers 1, 1 and rotates a screw rod 28 via bevel gears 27, 27'. A nut 30 fixed to a support frame 29 of the pick-off belts 9–10, 11–12 is screwed to this screw rod 28. The tip of the screw rod 28 is connected to a screw rod 34 via a flexible shaft 31. The screw rod 34 is a reversing screw relative to the screw of the abovementioned screw rod 28 which engages with a nut 33 fixed to a frame 33 of a hole puncher for punching the holes B, B. A sensor 35 for detecting the lip end of the film C is fitted to the frame 32 of the hole puncher. Further, the support frame 29 of the pick-off belts 9–10, 11–12 supports the support frame 36 of the wicket conveyor 21 movably in the bag conveying direction.

Accordingly, when the sensor 35 detects the lip end of the film C, the motor 26 equipped with a reduction gear rotates either in the normal direction or in the reverse direction and in turn rotates the screw rods 28 and 34 either normally or reversely so that the nuts 30 and 33 are capable of making fine adjustment of the support frame 29 of the pick-off belts 9–10, 11–12, the frame 32 of the hole puncher and the sensor 35 in the direction at right angles to the conveying direction of the film C, respectively.

A position adjuster 37 adjusts the positions of the wicket pins 20, 20 in the bag conveying direction and brings a screw rod 38, which is rotatably supported onto the support frame 29 of the pick-off belts 9–10, 11–12, into screw engagement with a nut 39 which is fixed to a support frame 39 of the wicket conveyor 21. When the screw rod 38 is rotated by a manual handle shaft 40 disposed on the support frame 29 of the pick-off belts 9–10, 11–12, the support frame 36 is caused to move forwardly and backwardly in the conveying direction of the film 36 thereby to perform the manual position adjustment.

Having the above-described construction, the embodiment of the invention operates in the following manner. First, the film C folded half and having a pair of holes B, B on its lip A is turned and conveyed by a pair of feed rollers 1, 1, which intermittently rotate, in a predetermined length, or, in such a manner that the tip portion of the film C is positioned ahead of the seal-knife 2 in the distance of the width of the bag to be produced. When the film C is then placed and stopped on the pick-off belts 10, 12 and on the pick-off roller 18, the leading edges of the pick-off belts 9, 11 are caused to descend by the action of the pick-off cam 14 and clamp both upper and lower end portions of the film C. Thereafter, the seal-knife 2 and the sealing roller 3 operate so as to cut the film C and simultaneously seal the same, thereby producing the bag D.

Next, the pick-off belts 9–10, 11–12 are rotated by the intermittent driving device 13, clamp the bag D, convey the bag to the end portion and then stop.

Subsequently, the pushers 23, 23' start operating and release both end portions of the bag D clamped by the pick-off belts 9–10, 11–12 therefrom and at the same time, the holes B, B are fitted onto the wicket pins 20, 20.

In this manner the bags D are sequentially stacked on the wicket pins 20, 20. When the predetermined number of the bags is counted by the preset counter and the bags are stacked in that predetermined number, the intermittent rotation of the feed rollers 1, 1 stops and the intermittent transfer of the film C also stops. Simultaneously, the piston rod 8 of the cylinder 7 starts contracting so that the feed roller 1 is rotated slightly reversely by the tension roller 6' and the leading edge portion of the film C is moved slightly backwardly, thereby preventing the leading edge portion of the film from being double-hit and damaged by the seal-knife 2.

On the other hand, the wicket conveyor 21 simultaneously rotates intermittently and moves forward the wicket pins 20, 20 of the stacked bags D and stops after deliverying the fresh wicket pins 20, 20 below the pushers 23. The bags D stacked in a predetermined number are then removed by the operator. After the abovementioned sequence of operations are completed, the feed rollers 1, 1 again start intermittent rotation and fit and stack the bags D to the wicket pins 20, 20.

I claim:

1. An apparatus for fitting and stacking bags on pins, comprising:

a pair of upper and lower feed rollers for gripping and intermittently feeding a film folded double to leave a lip portion having a pair of holes therein;

a sealing knife and a sealing roller disposed opposing each other on the front side of the front portions of said feed rollers and for quickly sealing and cutting said doubled film at the regular intervals between the intermittent feed motion of said feed rollers, and thereby forming bags in regular sequence;

two pairs of pick-off belts, each pair consisting of upper and lower belts, one pair of said belts being extended forward from positions in front of one end portion of said sealing knife and sealing roller, the other pair of said belts being extended forward from positions in front of the other end portion of said sealing knife and sealing roller, said two pairs of belts being so disposed as to grip both end portions of the bag;

an intermittent driving means for stopping said pick-off belts when the bag is being gripped thereby at starting end portions thereof and when the bag in a gripped state has been fed to terminal end portions thereof;

means for raising the starting end portions of said upper pick-off belts when the bags are fed;

a pair of pushers provided on the inner side of the terminal end portions of said two pairs of upper and lower pick-off belts, for releasing the bag from said belts;

a pair of wicket pins, positioned under the one of said pushers that is on the side of the lip of the bag, on which the paired holes in the lip of the bag may be fitted;

an intermittent transfer means for transferring said wicket pins when a predetermined number of bags have been stacked thereon;

first regulator means for adjusting the relative positions of said wicket pins and the holes in the lip of the bags in the direction normal to the bag-feeding direction, in the plane of the bags, automatically as the bags are advancing;

second regulator means for adjusting the relative positions of said wicket pins and the holes in the lips of the bags in the bag-feeding direction while the apparatus is in operation.

2. The apparatus for fitting and stacking bags onto pins in accordance with claim 1 further including reversing means for rotating slightly said lower feed roller in the reverse direction when said pair of upper and lower feed rollers stop the intermittent operation.

3. An apparatus in accordance with claim 1 further including first frame means for supporting said feed rollers and second frame means for supporting said wicket pins, and wherein said first regulator means comprises a sensor for detecting the edge of the lip of the bags being conveyed, a screw rod pivotably connected to said first frame means and extending in a direction normal to the bag-feeding direction, in the plane of the bags, a nut connected to said second frame means and meshed with said screw rod, and control means for causing said screw rod to turn and thereby adjust the position of said wicket pins in response to the position of the lip of the bags as detected by said sensor.

4. An apparatus in accordance with claim 1 further including a pick-off belt-supporting frame for supporting said pick-off belts and a wicket pin-supporting frame for supporting said wicket pins, and wherein said second regulator means comprises a screw rod pivotably connected to said pick-off belt-supporting frame and extending parallel to the bag-feeding direction, and a nut connected to said wicket pin-supporting frame and meshed with said screw rod, whereby the positions of said wicket pins in the bag feeding direction may be regulated by turning said screw rod.

5. An apparatus for fitting and stacking bags on pins according to claim 1, wherein said pick-off rollers are mounted fixedly in a vertically opposed relationship on intermediate portions of shafts extending between the starting end portions and said two pairs of upper and lower pick-off belts, and further including a plurality of belt conveyors, positioned between the starting end portions of said right and left lower pick-off belts in such a manner that the upper sections of said conveyor belts are in the same plane as those of the starting end portions of said lower pick-off belts to thereby permit the bags to be supported on the upper sections of said conveyor belts.

* * * * *